US005334029A

United States Patent [19]

Akkapeddi et al.

[11] Patent Number: 5,334,029

[45] Date of Patent: Aug. 2, 1994

[54] HIGH DENSITY CONNECTOR FOR STACKED CIRCUIT BOARDS

[75] Inventors: Kaushik S. Akkapeddi, Hanover Township, Morris County; Rocco Bonanni, Wayne Township, Passaic County, both of N.J.; Robert J. Gashler, Olathe, Kans.; Michael G. German, Secaucus, N.J.; William R. Lambert, Mendham Township, Morris County, N.J.; Eugene C. Schramm, Parsippany Township, Morris County, N.J.

[73] Assignee: AT&T Bell Laboratories, Murray Hill, N.J.

[21] Appl. No.: 59,844

[22] Filed: May 11, 1993

[51] Int. Cl.[5] ..... H01R 9/09

[52] U.S. Cl. ..... 439/66; 439/73

[58] Field of Search ..... 324/158 F, 158 P; 439/55, 66, 73, 74, 75, 80, 81, 91, 331, 607, 608

[56] References Cited

U.S. PATENT DOCUMENTS

| | | | |
|---|---|---|---|
| 3,077,511 | 2/1963 | Bohrer et al. | 439/69 X |
| 4,003,621 | 1/1977 | Lamp . | |
| 4,514,784 | 4/1985 | Williams et al. . | |
| 4,541,882 | 9/1985 | Lassen . | |
| 4,707,657 | 11/1987 | Boegh-Petersen | 324/158 F |
| 4,949,455 | 8/1990 | Nakamura et al. | 439/75 X |
| 5,045,249 | 9/1991 | Jin et al. . | |
| 5,049,982 | 9/1991 | Lee et al. . | |
| 5,140,405 | 8/1992 | King et al. | 439/91 X |
| 5,154,621 | 10/1992 | Legrady . | |
| 5,160,268 | 11/1992 | Hakamian . | |
| 5,171,290 | 12/1992 | Olla et al. | 439/71 |
| 5,174,763 | 12/1992 | Wilson | 439/66 |
| 5,216,807 | 6/1993 | Yoshizawa et al. | 439/66 X |

*Primary Examiner*—Khiem Nguyen
*Attorney, Agent, or Firm*—Lester H. Birnbaum

[57] ABSTRACT

Disclosed is a device for electrically coupling stocked circuit boards using conductive polymer interconnect material and a spacer element. In one embodiment, coaxial connection is provided by means of an array of wires within undulating metal envelopes. In another embodiment, pins are provided within holes in a plastic spacer. In a third embodiment, wires are laid on a substrate and successive laminations are built up to form the spacer element. In a fourth embodiment, wire arrays are extrusion molded within thermoplastic sheets which are laminated to form the spacer element.

10 Claims, 5 Drawing Sheets

HIGH DENSITY CONNECTOR FOR STACKED CIRCUIT BOARDS

BACKGROUND OF THE INVENTION

This invention relates to electrical interconnection of stacked circuit boards.

As space requirements have become more stringent, the need has arisen for providing stacked arrays of printed circuit boards with integrated circuit (IC) and other components mounted thereon. In addition to the requirement for electrical interconnection between the boards, a spacer is required to ensure sufficient board separation to accommodate the components and to allow for cooling air flow (see, e.g., U.S. Pat. No. 5,049,982 issued to Lee et al.).

For large board separations (i.e., 15 mm or more) and high density connections (i.e., less than 1.5 mm pitch) a high aspect ratio is required for the conductors interconnecting the boards. This aspect ratio is difficult to meet with standard electrical connectors. Further, the lack of precisely parallel board surfaces can result in connection failures.

U.S. Pat. No. 5,049,982, cited above, shows interconnection of circuit boards using layers of conductive polymer interconnect (CPI) material and a spacer therebetween. The spacers comprise pieces of printed circuit board with metal-coated vias therethrough for providing the electrical interconnection.

U.S. Pat. No. 4,514,784 issued to Williams et al. employs pins inserted in a connector block to interconnect circuit boards.

U.S. Pat. No. 5,160,268 issued to Hakamian provides interconnection between boards by means of a connector which includes an array of spring contacts on the top and bottom of the connector. Use of threaded inserts allows the connector to float between the stacked boards.

In U.S. Pat. No. 5,154,621 issued to Legrady, interconnection between boards is achieved by conductive pins mounted within undulating sockets, while the boards are separated by a spacer plate made of conductive material which is grounded to provide shielding.

These approaches, while generally adequate, are not easily implemented when high density interconnection and large board separations are required.

SUMMARY OF THE INVENTION

The invention is a connector for providing electrical connection between pads on the surfaces of stacked circuit boards. The connector comprises a pair of flexible sheets exhibiting anisotropic conduction between their major surfaces. The connector further includes a spacer element mounted between the pair of flexible sheets. The spacer element comprises an array of individual, stand-alone, conductive elements, which are held in place by a spacer body.

BRIEF DESCRIPTION OF THE DRAWING

These and other features of the invention are delineated in detail in the following description. In the drawing.

DETAILED DESCRIPTION

Figure 1:
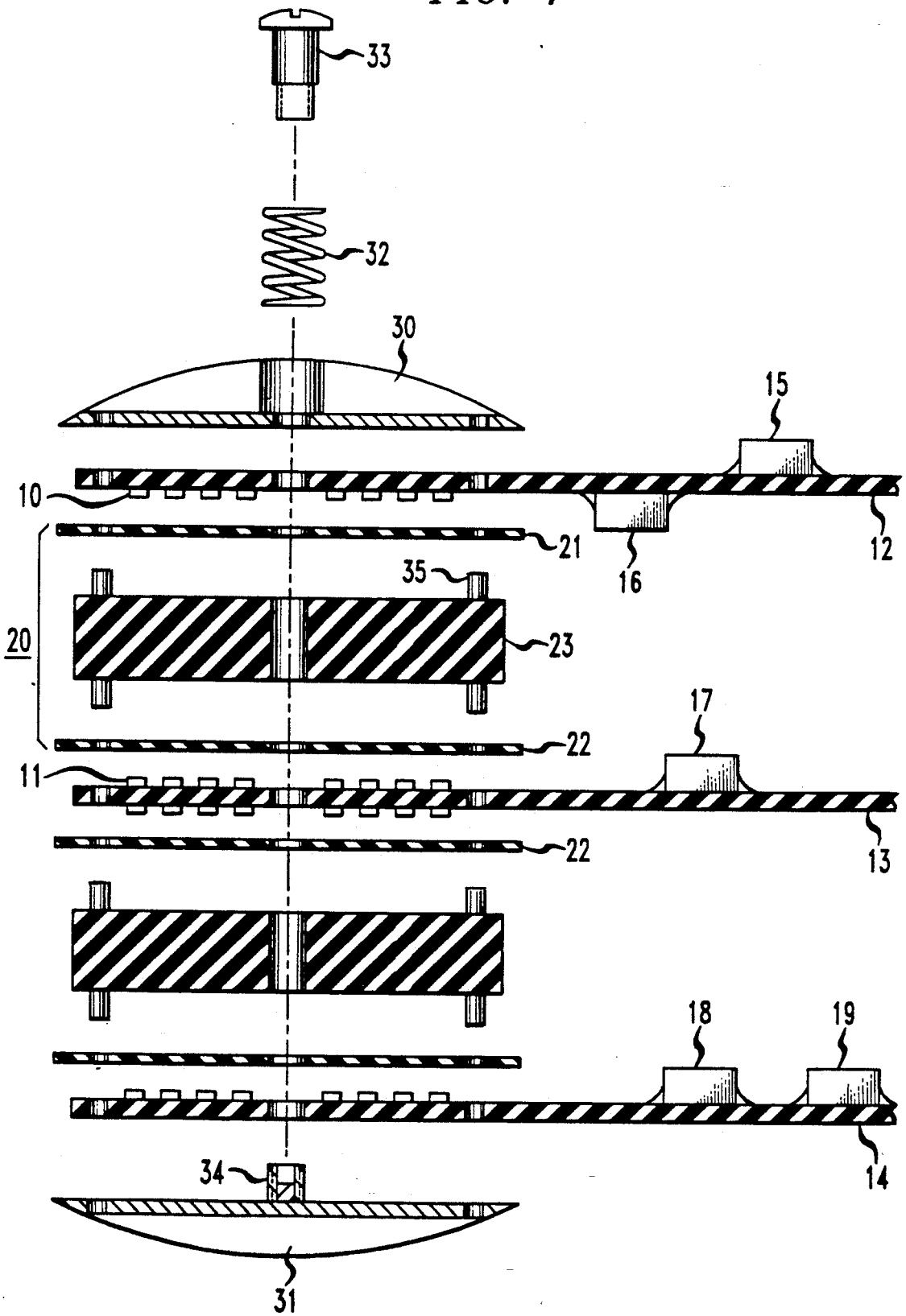
FIG. 1 an exploded cross-sectional view of a portion of a stacked array of printed circuit boards including connectors in accordance with the invention.

FIG. 1 illustrates a basic form of the invention for use in electrically connecting arrays of contact pads, e.g., 10 and 11, on stacked circuit boards, 12, 13 and 14. Each circuit board includes integrated circuit (IC) or other components, e.g., 15–19, on one or more major surfaces which are electrically coupled to the contact pads (e.g., 10 and 11). It will be appreciated that each board would typically include many more components and pads than shown in FIG. 1. Further, any number of boards could be stacked depending on particular needs. Also, the stacked boards need not all be the same size.

Typically, each board is approximately 0.25–2.5 mm thick. The invention is most advantageous when the pads on a board have a separation of less than 1.5 mm and the vertical spacing between boards is at least 15 mm, thus requiting a high aspect ratio connector. However, the invention may also be useful in situations where a very small gap between boards makes it difficult to use standard pin and socket connectors. It will also be appreciated that the boards could be stacked in a horizontal as well as vertical direction.

Each connector, 20, according to the invention includes a pair of conductive polymer interconnect (CPI) sheets, 21 and 22, on opposite major surfaces of a spacer element 23. CPI is a flexible material, usually containing Room Temperature Vulcanizing (RTV) silicone elastomer, which exhibits anisotropic conduction between the major surfaces of the sheets, i.e., in the vertical direction in FIG. 1. This anisotropic conduction can be effected by magnetically aligning conductive particles (not shown) within the material. (For an example of a CPI material, see, for example, U.S. Pat. No. 5,045,249 issued to Jin et al. and incorporated by reference herein.) The sheets are typically 0.125–1 mm thick.

The spacer element 23 is preferably a relatively rigid material which, according to various embodiments of the invention, can be a metal or a plastic. The body of the spacer will include individual, stand-alone, conductive elements, as described in more detail below, which extend from one major surface of the spacer body to the other major surface of the spacer body and are flush with the major surfaces or protrude therefrom sufficiently to make electrical contact with the CPI sheets 21 and 22. The spacer element would, typically, be 1–30 mm thick, but at least 15 mm thick in cases where a high aspect ratio connector is needed.

The stack and connectors are held in place by a clamping assembly which includes top, 30, and bottom, 31, half shells, one on either side of the stack. A spring 32 is inserted into a seat in the top shell along with a screw 33 which extends through holes in the boards, 12–14, sheets, e.g., 21–22, and spacers, e.g., 23, to a receptacle 34 in the bottom shell. Each spacer element can also include pegs, e.g., 35, extending therefrom through alignment holes in the boards, sheets and top and bottom shells to provide alignment in the X-Y plane of the boards. The screw 33 provides alignment in the Z-direction (vertical) by exerting a uniform force in that direction over the major surfaces of the boards, sheets and spacers. This uniform force results from the fact that the screw is spring loaded and situated in the center of the clamping assembly. Further, if the shells 30 and 31 are made of metal, the clamping assembly provides good heat sinking capability.

Figure 2:
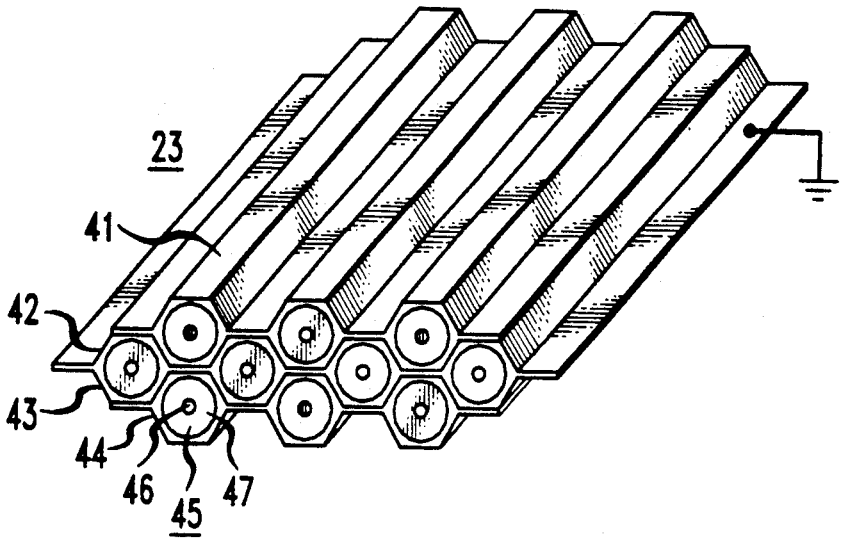
FIG. 2 is a perspective view of a portion of the connector of FIG. 1 in accordance with a first embodiment of the invention.

FIG. 2 illustrates a form of spacer element, 23, in accordance with an embodiment of the invention. The spacer body comprises layers of undulating metal material, 41–44, such as brass or stainless steel. Each layer is, typically, 0.1–0.5 mm thick. The undulating layers form a honeycomb configuration as shown. Within the spaces formed by the metal layers is an array of wires, e.g., 45, each of which includes a conductive portion, e.g., 46, surrounded by an insulating coating, e.g., 47. The conductive portion is typically copper, and the insulating coating is typically TEFLON®. The insulated wires fit snugly within the spaces of the metal layer to essentially form a fixed array of conductors through the spacer body when the spacer is used in the assembly of FIG. 1. That is, each wire, e.g., 45, will provide an electrical connection between corresponding pads (e.g., 10 and 11) of two circuit boards. The undulating metal layers 41–44 can be grounded to provide a shielding of the conductors as in a coaxial cable. This is an especially desirable feature for large board spacings (greater than 25 mm) since the signals would otherwise tend to degrade over such distances. This feature is also useful for high frequency signals.

The undulating metal layers can be formed, for example, by metal rolling using gear wheels rather than smooth rollers. The wires can be placed in the openings as the layers are stacked, and the layers can be held together by welding in the areas of mechanical contact between the layers.

Figure 3:
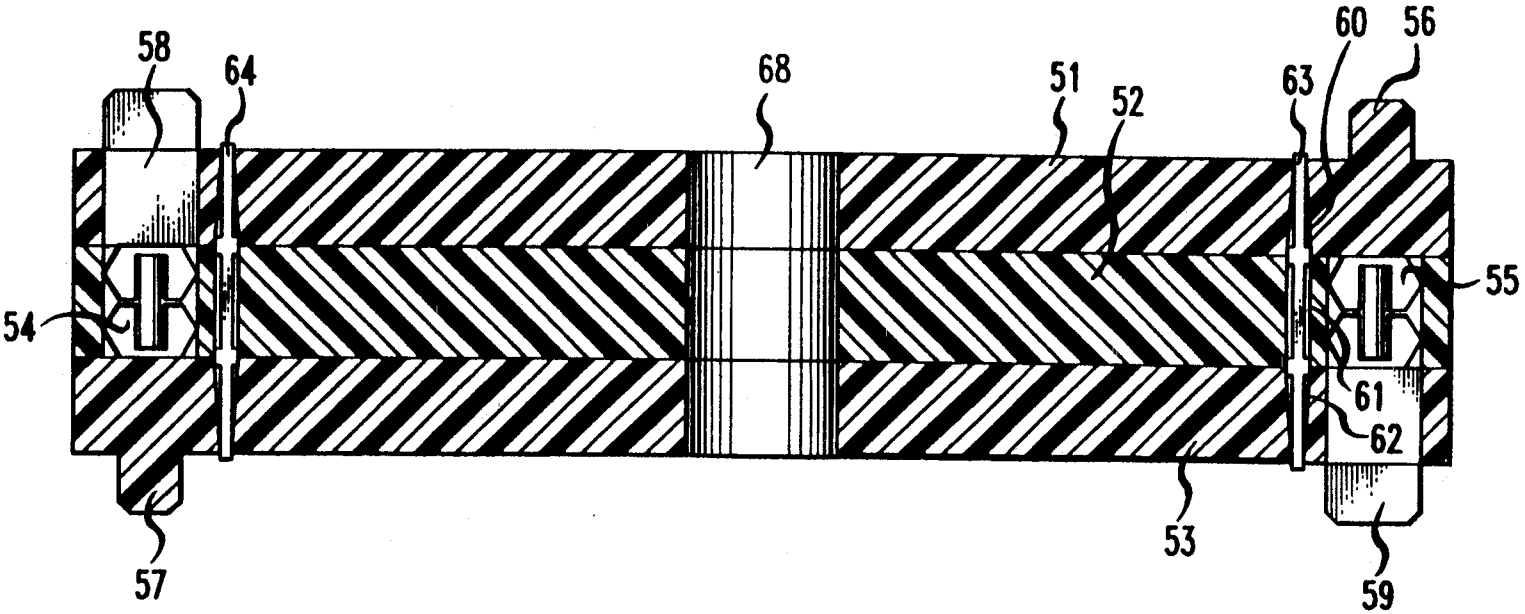
FIG. 3 is a cross-sectional view of a portion of the connector of FIG. 1 in accordance with an alternative embodiment of the invention.

In FIG. 3, the spacer body comprises a plurality of insulating blocks (in this example, three blocks 51–53). The insulating blocks are typically made of plastic and are held together by press-fit pegs 54 and 55 near the edges of the blocks. Blocks 51 and 53 each include at least one alignment peg (56 and 57, respectively) and at least one alignment hole (58 and 59, respectively) for use in aligning the spacer with the printed circuit boards (12–14 of FIG. 1) which will be electrically interconnected. Center hole 68 through the blocks receives the clamping screw (33 of FIG. 1).

Blocks 51–53 also include an array of aligned holes (e.g., 60, 61, 62) for receiving therein an array of conductive pins, only two of which are illustrated as pins 63 and 64. The pins are typically made of copper alloy and have a length which is slightly in excess of the combined thicknesses of blocks 51–53 to ensure good electrical contact from one surface of the spacer to the opposite surface.

Figure 4:
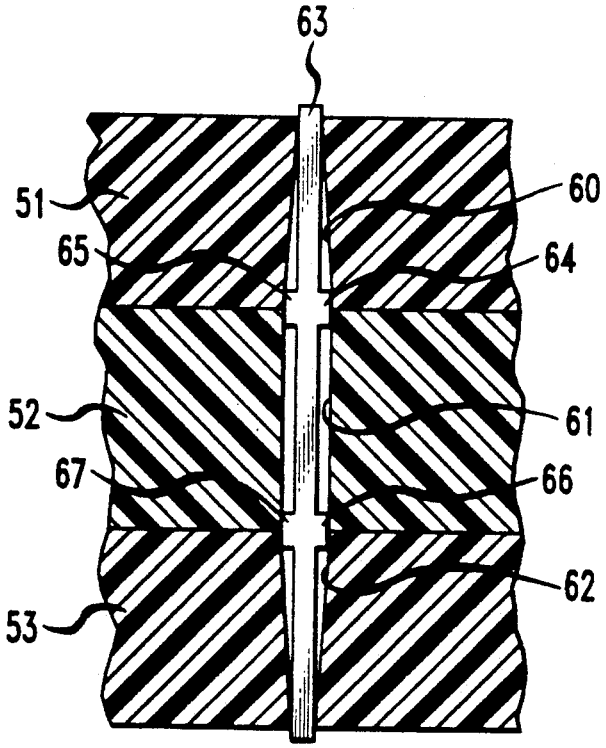
FIG. 4 is an enlarged view of a portion of the connector of FIG. 3.

As illustrated more clearly in the enlarged view of FIG. 4, the holes in blocks 51 and 53 (e.g., 60 and 62) which contain the pins (e.g., 63) are tapered, while the hole 61 in block 52 which contains the pin has a uniform width. The pin 63 also includes a pair of shoulders (64, 65 and 66, 67) spaced from the ends of the pin such that the shoulders make physical contact with a corresponding tapered hole (60 or 61). The pin 63, therefore, is free to "float" in a vertical direction in order to adjust to any warpage or other irregularity in the circuit boards.

Figure 5:
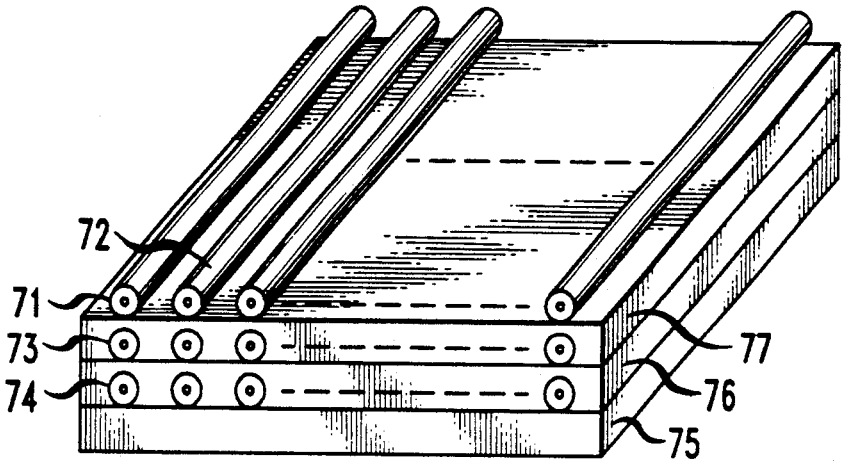
FIG. 5 is a perspective view of a portion of the connector of FIG. 1 in accordance with a still further embodiment of the invention.

FIG. 5 illustrates yet another embodiment where, similar to the FIG. 2 embodiment, the conductive elements comprise an array of wires, e.g., 71–74. The wires are formed in rows, each row deposited on the major surface of an insulating substrate 75–77. Typically, the substrates would be polymer sheets with thicknesses in the range 0.5–3 mm. The wires, again, could be standard copper conductors coated with an insulation covering.

Figure 6:
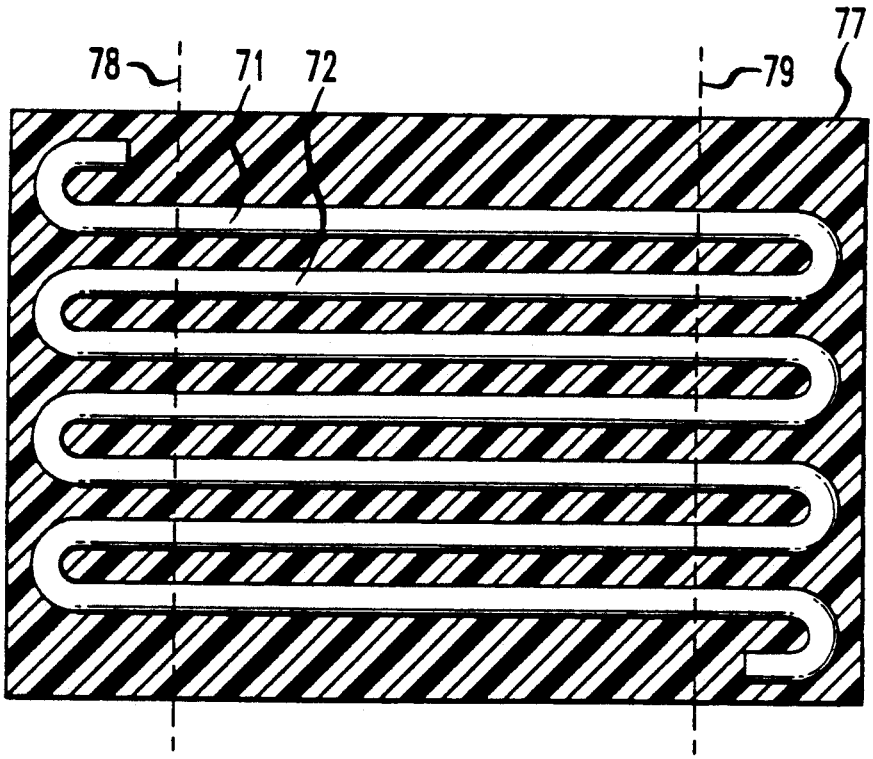
FIG. 6 is a top view of the connector portion of FIG. 5 during a certain stage of fabrication.

As illustrated in the plan view of FIG. 6, a row of wires can be formed by routing a single wire on the surface of a substrate which includes an adhesive (not shown) to hold the wire in place. (For an example of such a process, see U.S. Pat. No. 4,541,882 issued to Lassen.) The substrate can also include a metal foil (not shown) which can be employed for shielding purposes. The various substrates with the wire patterns on their major surfaces can be stacked and held together with adhesives, metal fixtures or press-fit pins. The stack can then be cut along the dashed lines 78 and 79 to separate the wire on each surface into a row of individual wires as shown in FIG. 5. The cut surfaces of the structure can be polished fiat, or a serrated cutting tool could be used so that the wires protrude from the cut surfaces.

The structure of FIG. 5, when placed with the wires in a vertical position, can act as the spacer element for the connector of FIG. 1.

Figure 7:
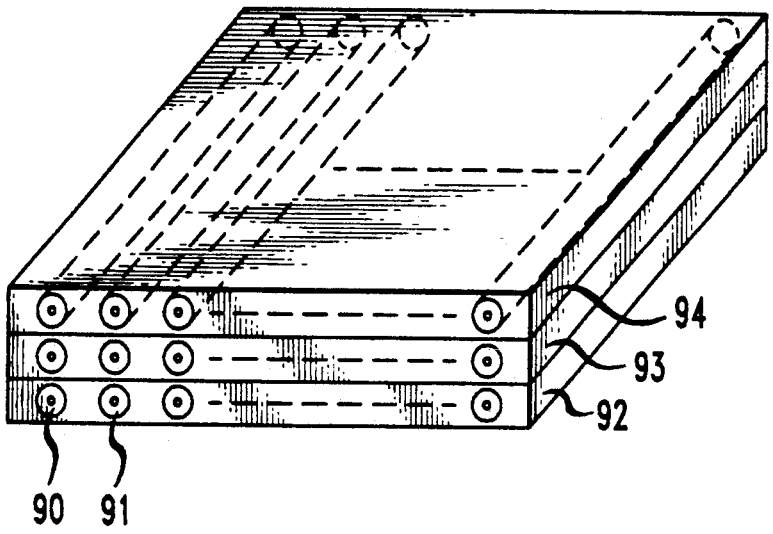
FIG. 7 is a perspective view of a portion of the connector of FIG. 1 in accordance with a still further embodiment of the invention.

In accordance with a further embodiment, as shown in FIG. 7, rather than place wires on the surfaces of substrates, rows of copper wires, e.g., 90 and 91, can be extrusion molded in thermoplastic sheets, e.g., 92. Sections of the extruded plastic with the embedded wire therein are cut to length with a serrated or fiat cutting tool, and then several sheets, 92–94, can be laminated to construct the appropriate conductive array for the spacer element. As in the previous embodiment, the sheets can be held together with an adhesive, metal fixtures, or press-fit pins.

Various additional modifications of the invention will become apparent to those skilled in the art. All such variations which basically rely on the teachings through which the invention has advanced the art are properly considered within the scope of the invention.

We claim:

1. A connector for providing electrical connection between pads on the surfaces of stacked circuit boards comprising:

a pair of flexible sheets, each having major surfaces and exhibiting anisotropic conduction between the major surfaces;

a spacer element mounted between the pair of flexible sheets, the spacer element comprising an array of individual, stand-alone, conductive elements which are held in place by a spacer body; and a clamping assembly which aligns the spacer and stack of circuit boards in three perpendicular directions and includes a spring-loaded screw assembly comprising a screw inserted within a coil spring for exerting a uniform force over the major surfaces of the sheets.

2. The connector according to claim 1 wherein the spacer body is a rigid material.

3. The connector according to claim 1 wherein the flexible sheets comprise room temperature vulcanized silicone rubber with magnetically aligned conductive particles extending between the major surfaces to provide the anisotropic conduction.

4. The connector according to claim 1 wherein the conductive elements comprise insulation coated wires.

5. The connector according to claim 4 wherein the spacer body comprises a plurality of stacked undulating conductive sheets with the wires located within spaces formed between adjacent conductive sheets.

6. The connector according to claim 5 wherein the conductive sheets are electrically grounded to provide an electromagnetic shield for the wires.

7. The connector according to claim 1 wherein the conductive elements are spaced less than 1.5 mm apart, and the spacer element is at least 15 mm thick.

8. The connector according to claim 1 wherein the screw is located in the center of the clamping assembly.

9. The connector according to claim 1 wherein the clamping assembly further comprises top and bottom half shells, one on either side of the stacked circuit boards.

10. The connector according to claim 1 wherein the conductive elements have flat surfaces which contact the sheets.

* * * * *